US005976447A

United States Patent [19]

Mills et al.

[11] Patent Number: 5,976,447

[45] Date of Patent: Nov. 2, 1999

[54] PROCESS FOR THE PREPARATION OF POLYBENZOXAZOLE AND POLYBENZOTHIAZOLE FILAMENTS AND FIBERS

[75] Inventors: Michael E. Mills; Willard Alexander; Timothy L. Faley; Chieh-Chun Chau, all of Midland, Mich.

[73] Assignee: Toyobo Co., Ltd., Osaka, Japan

[21] Appl. No.: 08/668,784

[22] Filed: Jun. 24, 1996

Related U.S. Application Data

[63] Continuation-in-part of application No. 08/363,049, Dec. 23, 1994, abandoned.

[51] Int. Cl.[6] ..... D01F 6/26

[52] U.S. Cl. ..... 264/344; 264/345

[58] Field of Search ..... 264/344, 345

[56] References Cited

U.S. PATENT DOCUMENTS

| | | | |
|---|---|---|---|
| 3,869,430 | 3/1975 | Blades | 528/348 |
| 4,370,290 | 1/1983 | Makino et al. | 264/184 |
| 4,554,119 | 11/1985 | Chenevey | 264/85 |
| 4,581,437 | 4/1986 | Mammone | 264/345 |
| 5,273,703 | 12/1993 | Alexander et al. | 264/184 |
| 5,288,445 | 2/1994 | Tani et al. | 264/85 |
| 5,288,452 | 2/1994 | Yabuki | 264/345 |
| 5,411,694 | 5/1995 | Alexander et al. | 264/184 |
| 5,417,915 | 5/1995 | Chau et al. | 264/345 |

FOREIGN PATENT DOCUMENTS

| | | |
|---|---|---|
| WO 94/04726 | 3/1994 | WIPO . |
| WO 94/12704 | 6/1994 | WIPO . |
| WO 94/12705 | 6/1994 | WIPO . |
| WO 94/12706 | 6/1994 | WIPO . |

OTHER PUBLICATIONS

Chau et al., Abstract submitted of meeting of the American Physical Society, entitled "Strain Rate Sensitivity and Strain Hardening Behavior of PBO Fiber", Mar. 21–25, 1994.

*Primary Examiner*—Leo B. Tentoni
*Attorney, Agent, or Firm*—Morrison & Foerster LLP

[57] ABSTRACT

A continuous process for heating a polybenzazole or polybenzothiazole filament, which includes the step of heating the filament to a temperature of at least 100° C. but no greater than 290° C. while applying a tension thereto of at least 3.5 grams per denier, which is carried out at a line speed of at least 100 m/minute; and there is no prior or subsequent heating of the fiber to any temperature greater than 300° C. It has been discovered that placing tension on the filament while it is dried increases its tensile modulus without a significant decrease in its tensile strength.

19 Claims, No Drawings

PROCESS FOR THE PREPARATION OF POLYBENZOXAZOLE AND POLYBENZOTHIAZOLE FILAMENTS AND FIBERS

CROSS REFERENCE TO RELATED APPLICATION

This application is a Continuation-in-Part of the application Ser. No. 08/363,049, filed Dec. 23, 1994, now abandoned.

BACKGROUND OF THE INVENTION

The present invention relates to a process for the preparation of polybenzoxazole or polybenzothiazole filaments and fibers.

Fibers prepared from polybenzoxazole (PBO) and polybenzothiazole (PBT) (hereinafter referred to as PBZ or polybenzazole polymers) may be prepared by first extruding a solution of polybenzazole polymer in a mineral acid (a polymer "dope") through a die or spinneret to prepare a dope filament. The dope filament is then drawn across an air gap, washed in a bath comprising water or a mixture of water and a mineral acid, and then dried. If multiple filaments are extruded simultaneously, they may then be combined into a multifilament fiber before, during, or after the washing step.

Dried polybenzazole fibers prepared by such a process are known to have a tensile modulus in the range of from about 20 to about 25 Msi. For certain applications however, a higher tensile modulus is desirable. Accordingly, processes are known for preparing fibers with a higher tensile modulus, by washing and drying a spun fiber, and then heat-treating the fiber at a temperature of at least about 350° C. Such processes are described, for example, in U.S. Pat. No. 5,288,445. However, such processes typically require the fiber to have been dried to a residual moisture content of less than about 2 percent and a residual solvent content of less than about 2 percent prior to heat-treatment, in order to obtain a fiber with good physical properties. Further, such heat-treating processes add to the time and expense necessary to prepare a suitable fiber. In addition, such heat-treatment processes typically result in a measurable decrease in the tensile strength of the fiber. While such fibers may be useful for certain applications, further improvement in the physical properties of the fiber is desirable.

SUMMARY OF THE INVENTION

In one aspect, this invention is a continuous process for heating a polybenzazole or polybenzothiazole filament, which comprises the step of heating the filament to a temperature of at least 100° C. but no greater than 290° C. while applying a tension thereto of at least 3.5 grams per denier, which is carried out at a line speed of at least 100 m/minute; and there is no prior or subsequent heating of the fiber to any temperature greater than 300° C.

It has been discovered that placing tension on the filament while it is being dried increases its tensile modulus without a significant decrease in its tensile strength. Further, the increased line tension also permits wraps of the filaments (or multifilament fibers) to be spaced more closely on rollers which are typically employed in fiber-spinning processes, thereby decreasing the amount of equipment necessary for the preparation of fibers when such equipment is employed. In addition, a high modulus filament may be obtained by this process which also has a relatively high solvent and moisture content, as compared with filaments which are to be heat-treated. The ability to prepare fibers with good physical properties and a high moisture and solvent content may also decrease the amount of equipment necessary for the washing, drying, and heat-treating of the fiber. These and other advantages of the invention will be apparent from the description which follows.

DETAILED DESCRIPTION OF THE INVENTION

In the process of the invention, the filament is dried by heating it to a temperature in the range of from about 25° C. to about 300° C., while applying a tension thereto of at least 3.5 grams per denier, which is carried out at a line speed of at least 100 m/minute; and there is no prior or subsequent heating of the fiber to any temperature greater than 300° C. The drying may be carried out by any suitable method of heating the filament, such as passing the filament through an oven device or contacting it with a heated roller device, but is preferably carried out by contacting it with a heated roller device operating in a heated, insulated enclosure.

In a continuous spinning operation, the filament preferably travels around paired rollers a number of times in order to obtain the longest possible residence time for the particular drying apparatus, and may come in contact with several such devices arranged in series. The temperature at which such devices are set is preferably at least about 25° C., more preferably at least about 100° C., more preferably at least about 125° C., most preferably at least about 150° C.; but is preferably no greater than 270° C., more preferably no greater than 250° C. Preferably, at no time during the continuous process for its preparation is the filament heated to a temperature greater than 290° C., more preferably no greater than 270° C., and most preferably no greater than 250° C. The residence time necessary for the drying step in order for the filaments to reach the desired levels of residual moisture content will depend on several factors, including the denier of the filaments and the temperature of the drying devices. The residual moisture content of the filament after it is dried is preferably no greater than about 15 percent, more preferably no greater than about 10 percent, and most preferably no greater than about 5 percent, although of course the initial moisture content may be less than 15 percent. The term "initial moisture content" as used herein refers to the moisture content of the filament at the time that the process of the invention is begun. The moisture content of the filament may be determined by dividing the difference between the weight of the filament prior to and after drying it at a temperature of about 250° C. for about 12 hours, by the weight of the filament after such drying. Preferably, the initial moisture content of the filament is at least about 5 percent, more preferably at least about 10 percent, and most preferably at least about 15 percent.

During the drying process, the tension on the filament is preferably at least about 3.5 grams per denier (gpd). More preferably, the line tension is at least about 5.0 gpd, more preferably at least about 10.0 gpd, more preferably at least about 15.0 gpd, and most preferably at least about 20.0 gpd; but is preferably no greater than about 35.0 gpd, more preferably no greater than about 32.0 gpd, more preferably no greater than about 30.0 gpd, and most preferably no greater than about 25.0 gpd.

However, the preferred tension values may alternatively be expressed as a percentage of the tensile strength of the filament, since the initial tensile strength of the filament may vary depending on the molecular weight of the polybenzazole polymer and the filament spinning conditions. The tension on the filaments is preferably at least about 9 percent of their tensile strength (measured according to ASTM D-885 at 23° C.). If the spinning line is being set up, this value may be determined by applying at least about 3.5 grams per denier (gpd) tension to the line, measuring the tensile strength of the filament or fiber produced thereby, and then adjusting the tension on the spinning line upwards (if necessary) in an iterative process until the tension on the line corresponds to at least about 9 percent of the tensile strength of the filament or fiber produced on such line. For example, if the tensile strength of the fiber is 800 Ksi (40 grams per denier (gpd)), then the line tension is at least about 3.6 gpd. More preferably, the line tension is at least about 25 percent of the tensile strength of the filament or fiber, more preferably at least about 50 percent; but is preferably no greater than about 90 percent, more preferably no greater than about 80 percent.

The drying process is preferably carried out as a continuous, on-line process by drying the filament (or multifilament fiber) while it is traveling at a relatively constant rate of speed down the process "line," and that no "off-line" procedures wherein the filament is spooled, cut, and removed from the line for subsequent processing are involved, until the filament has reached the final residual moisture content specified above.

In a typical continuous spinning operation, the tension on the filament will be fairly uniform, or increasing, across the entire spinning line (from the first washing bath to the point at which the filament is collected, including both the washing and drying steps) if the line is run at a constant speed. If the tension is not uniform across the line, the tension values referred to above refer to the tension on the filament on at least one point in the line during the drying process. In such cases, the moisture content of the filament when the tension values referred to above are applied is preferably no greater than about 25 percent, more preferably no greater than about 15 percent. The line speed is preferably at least about 150 m/min, more preferably at least about 250 m/min, and most preferably at least about 350 m/min. Tension may be applied to the filament by any suitable means, such as by running the roller devices at different speeds, or by using devices which apply friction to the filament.

Polybenzazole dope filaments for use in the process of the present invention may be prepared by the extrusion of a polybenzazole dope through a die containing a plurality of small diameter holes, or a "spinneret." The polybenzazole dope comprises a solution of polybenzazole polymer in polyphosphoric acid. The term "polybenzazole" as used herein refers to polybenzoxazole ("PBO") and polybenzothiazole ("PBT"). PBO, PBT and random, sequential and block copolymers of PBO and PBT are described in references such as Wolfe et al., *Liquid Crystalline Polymer Compositions, Process and Products,* U.S. Pat. No. 4,703,103 (Oct. 27, 1987); Wolfe et al., *Liquid Crystalline Poly (2,6-Benzothiazole) Compositions, Process and Products,* U.S. Pat. No. 4,533,724 (Aug. 6, 1985); Wolfe, *Liquid Crystalline Polymer Compositions, Process and Products,* U.S. Pat. No. 4,533,693 (Aug. 6, 1985); Evers, *Thermo-oxidatively Stable Articulated p-Benzobisoxazole and p-Benzobis-thiazole Polymers,* U.S. Pat. No. 4,359,567 (Nov. 16, 1982); Tsai et al., *Method for Making Heterocyclic Block Copolymer,* U.S. Pat. No. 4,578,432 (Mar. 25, 1986); Ency. Poly. Sci. & Eng., *Polybenzothiazoles and Polybenzoxazoles,* Vol. 11, p. 601 (J. Wiley & Sons 1988); and W. W. Adams et al., *The Materials Science and Engineering of Rigid-Rod Polymers* (Materials Research Society 1989), which are incorporated herein by reference. The polybenzazole polymer may be a rigid rod, semi-rigid rod or flexible coil polymer. It is preferably a lyotropic liquid-crystalline polymer, which forms liquid-crystalline domains in solution when its concentration exceeds a critical concentration. The intrinsic viscosity of rigid polybenzazole polymers in methanesulfonic acid at 25° C is preferably at least about 10 dL/g, more preferably at least about 15 dL/g and most preferably at least about 20 dL/g.

The dope should contain a high enough concentration of polymer for the polymer to form an acceptable filament after extrusion and washing. When the polymer solution is lyotropic liquid-crystalline, then the concentration of polymer in the dope is preferably high enough to provide a liquid-crystalline dope. The concentration of the polymer is preferably at least about 7 weight percent, more preferably at least about 10 weight percent and most preferably at least about 14 weight percent. The maximum concentration is limited primarily by practical factors, such as polymer solubility and dope viscosity. The concentration of polymer is preferably no more than 30 weight percent, and more preferably no more than about 20 weight percent.

Suitable polybenzazole polymers or copolymers and dopes can be synthesized by known procedures, such as those described in Wolfe et al., U.S. Pat. No. 4,533,693 (Aug. 6, 1985); Sybert et al., U.S. Pat. No. 4,772,678 (Sep. 20, 1988); Harris, U.S. Pat. No. 4,847,350 (Jul. 11, 1989); and Gregory et al., U.S. Pat. No. 5,089,591 (Feb. 18, 1992), which are incorporated herein by reference. In summary, suitable monomers are reacted in a solution of nonoxidizing and dehydrating acid under nonoxidizing atmosphere with vigorous mixing and high shear at a temperature that is increased in step-wise or ramped fashion from no more than about 120° C. to at least about 190° C.

Units within the PBO or PBT polymer are preferably chosen so that the polymer is lyotropic liquid-crystalline. Preferred monomer units are illustrated in the formulae below. The polymer more preferably consists essentially of monomer units selected from those illustrated, and most preferably consists essentially of cis-polybenzoxazole, trans-polybenzoxazole, or trans-polybenzothiazole.

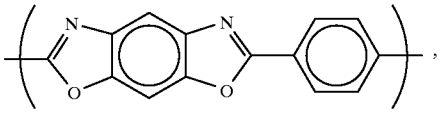

cis-polybenzoxazole
Poly[benzo(1,2-d:5,4-d')bisoxazole-2,6-diyl-1,4-phenylene]

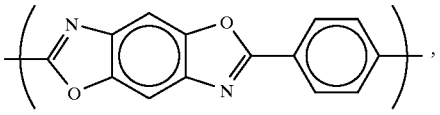

trans-polybenzoxazole
Poly[benzo(1,2-d:4,5-d')bisoxazole-2,6-diyl-1,4-phenylene]

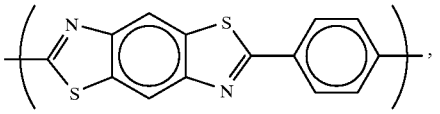

trans-polybenzothiazole

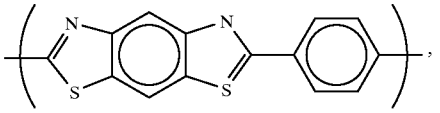

cis-polybenzothiazole

-continued

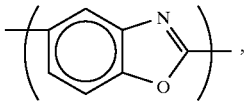

AB-PBO
Poly(2,5-benzoxazole)

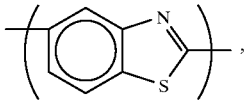

Poly(2,5-benzothiazole)

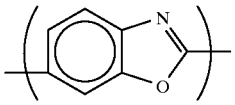

AB-PBO
Poly(2,6-benzoxazole)

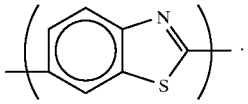

Poly(2,6-benzothiazole)

The dope may then be formed into a filament by extrusion through a spinneret, and drawing the filament across a gap. Suitable processes are described in the references previously incorporated and U.S. Pat. No. 5,034,250, which is incorporated herein by reference. The spinneret preferably contains a plurality of holes. The number of holes in the spinneret and their arrangement is not critical to the invention, but it is desirable to maximize the number of holes for economic reasons. The spinneret may contain as many as 100 or 1000 or more holes, and they may be arranged in circles, grids, or in any other desired arrangement. The spinneret may be constructed out of ordinary materials that will not be degraded by the dope, such as stainless steel. The stability of the spinning operation may be enhanced by use of a stress isolation device as described in copending U.S. patent application Ser. No. 08/286,297, filed Aug. 5, 1994, by Faley et al., entitled "Method for Preparing Polybenzoxazole and Polybenxothiazole Fibers."

Dope exiting the spinneret enters a gap between the spinneret and a washing bath. The gap is typically called an "air gap" although it need not contain air. The gap may contain any fluid that does not remove the acid solvent or react adversely with the dope, such as air, nitrogen, argon, helium or carbon dioxide. The dope is preferably drawn to a spin-draw ratio of at least about 20, preferably at least about 40, and more preferably at least about 50. The spin-draw ratio is defined in this application as the ratio between the take-up velocity of the filaments and the capillary velocity ($v_c$) of the dope in the spinneret hole. The draw should be sufficient to provide a filament having the desired diameter.

The drawn filament is then washed to remove most of the acid solvent contained therein. The washing of the filament is preferably carried out under conditions sufficient to reduce the solvent content of the filament to less than about 15 percent by weight, and more preferably less than about 10 percent by weight, more preferably less than 7 percent by weight, and most preferably less than about 3 percent by weight, based on the weight of the finished fiber. Suitable washing fluids include any liquid which is a non-solvent for the polymer, but which will dilute the acid solvent in the dope filament. Examples of washing fluids include water and mixtures of water and the solvent of which the polybenzazole dope is comprised. Preferably, the dope is prepared utilizing polyphosphoric acid and the washing fluid is a mixture of water and polyphosphoric acid. The residual solvent content of the filament may be determined by analyzing the filament for the mineral of which the solvent acid is comprised. For example, if the solvent is polyphosphoric acid, the amount of residual phosphorous in the filament may be measured using X-ray fluorescence on a Philips PW1404/DY685 sequential spectrometer with a scandium X-ray tubes and filament samples which have been pressed into a pellet for analysis, and the amount of polyphosphoric acid in the filament calculated therefrom.

Washing of the filament is preferably carried out in a continuous process by running the filament(s) through a series of baths or washing cabinets. Washing cabinets typically comprise an enclosed cabinet containing one or more roll pairs which the filament travels around a number of times, and across, prior to exiting the cabinet. As the filament travels around the roll, it is sprayed with a washing fluid. The washing fluid is continuously collected in the bottom of the cabinet and drained therefrom.

The temperature of the washing fluid is preferably at least about 5° C., more preferably at least about 15° C., and is preferably no greater than about 150° C., more preferably no greater than about 75° C. The washing fluid may also be applied in vapor form (steam), but is more conveniently used in liquid form. The residence time of the filament in the washing bath(s) will depend on the desired concentration of residual solvent in the filament, but typical residence times are in the range of from about 2 minutes to about 30 minutes. The duration of the washing step is preferably no greater than about 20 minutes, more preferably no greater than about 10 minutes.

The concentration of solvent in the filament is preferably reduced as quickly as is practical in the washing step. The concentration of solvent in the washing baths or cabinets is preferably at least about 0.2 percent by weight, and is preferably no greater than about 40 percent by weight, based on the weight of the washing fluid. The tension on the filament during the washing is preferably at least about 1.0 gpd, more preferably at least about 1.5 gpd, and is most preferably at least about 2.0 gpd; but is preferably no greater than about 10.0, more preferably no greater than about 7.5 gpd, and is most preferably no greater than about 5.0 gpd.

The filament utilized in the process of the invention may be combined with other filaments to form a multifilament fiber at any point during the process of the invention. Preferably, however, the filaments are combined just prior to, or during, the first washing bath. While the term "filament" is used throughout this application to describe the process of the invention, the process of the invention may also be carried out with a filament contained in a multifilament fiber, utilizing the same process parameters as described herein for use with a single filament.

The tensile strength of the filaments produced by the process of the invention is preferably at least about 600 Ksi (600,000 psi), and is more preferably at least about 800 Ksi. The tensile modulus of the filaments produced by the process of the invention is preferably at least about 30 Msi ($30\times10^6$ psi), and more preferably at least about 40 Msi.

ILLUSTRATIVE EMBODIMENTS

The following examples are given to illustrate the invention and should not be interpreted as limiting it in any way. Unless stated otherwise, all parts and percentages are given by weight.

EXAMPLE 1

A fourteen weight percent solution of polybenzoxazole (having an inherent viscosity of about 30 g/dL, measured at 25° C., in a nearly saturated solution of methanesulfonic acid anhydride in methanesulfonic acid at a concentration of 0.046 g/dL) is prepared by polymerizing diaminoresorcinol 2HCl and terephthalic acid in polyphosphoric acid (enriched with $P_2O_5$ to provide a $P_2O_5$ content of about 83.9 percent). The resulting dope is extruded at a temperature of about 170° C. out of a spinneret with 42 holes, and is drawn across an air gap and into a bath located about 50 cm from the spinneret. The diameter of each orifice at the exit point is 0.18 millimeters (mm), the velocity of PBO dope through each orifice is 4.8 meters/minute (m/min) and the PBO throughput/orifice is 0.24 grams/minute (g/min). The spin-draw ratio utilized is 42, the velocity of the filaments as they enter the bath (line speed) is 200 meters/minute.

The air gap is partially enclosed in order to minimize air currents therein. The filaments are washed in a bath of deionized water, and the residence time in this initial washing stage is about 0.5 seconds and the temperature is about 10° C. The filaments are combined into a multifilament fiber during the subsequent washing. The filaments have a denier of 1.5 denier per filament.

The fibers are then thoroughly washed by spraying with water and dried by contacting the fibers with heated godet rolls in a heated cabinet, while applying a tension to the fiber as specified in Table 1. The residence time of the fibers on the heated godet rolls is sufficient to permit the fiber to reach the temperature of the rolls. Tension is produced by running the roller devices in the process at different speeds. Tension on the fiber is measured on the fiber bundle at the entrance to the drying device using a tensiometer. The results are shown in the table below. The tensile strength, tensile modulus, and elongation at break of the fiber is measured according to ASTM D-885.

TABLE 1

| Example No. | Tension (gpd) | Dryer Temp. (° C.) | Tensile Strength (Ksi) | Tensile Modulus (Msi) | Elong. @ Break (%) |
|---|---|---|---|---|---|
| 1a | 7.3 | 25 | 825 | 28.9 | 3.1 |
| 1b | 10.5 | 25 | 832 | 31.7 | 2.9 |
| 1c | 15.8 | 25 | 838 | 35.1 | 2.7 |
| 1d | 7.3 | 100 | 851 | 31.3 | 3.0 |
| 1e | 10.5 | 100 | 832 | 34.2 | 2.8 |
| 1f | 15.8 | 100 | 830 | 36.4 | 2.6 |
| 1g | 7.3 | 200 | 819 | 36.7 | 2.7 |
| 1h | 10.5 | 200 | 818 | 37.7 | 2.5 |
| 1j | 15.8 | 200 | 809 | 38.6 | 2.3 |
| 1k | 7.3 | 300 | 838 | 39.7 | 2.5 |
| 1m | 10.5 | 300 | 817 | 41.0 | 2.2 |
| 1n | 15.8 | 300 | 823 | 43.8 | 1.9 |

What is claimed is:

1. A continuous process for heating a polybenzazole or polybenzothiazole filament, which comprises the step of heating the filament to a temperature of at least 100° C. but no greater than 290° C. while applying a tension thereto of at least 3.5 grams per denier at a line speed of at least 100 m/minute; but which does not include any prior or subsequent heating of the fiber to any temperature greater than 290° C.

2. The process of claim 1 which is carried out at a line speed of at least about 150 m/min.

3. The process of claim 1 wherein the filament has an initial moisture content of at least about 5 percent.

4. The process of claim 1 wherein the filament has an initial moisture content of at least about 10 percent.

5. The process of claim 1 wherein the filament has an initial moisture content of at least about 15 percent.

6. The process of claim 5 wherein the filament is dried to a residual moisture content of less than about 10 percent.

7. The process of claim 4 wherein the filament is dried to a residual moisture content of less than about 5 percent.

8. The process of claim 1 wherein the tension is at least about 10.0 gpd.

9. The process of claim 1 wherein the tension is at least about 20.0 gpd.

10. The process of claim 1 wherein the tensile modulus of the filament obtained by the process is at least about 30 Msi.

11. The process of claim 1 wherein the tensile modulus of the filament obtained by the process is at least about 40 Msi.

12. A process for drying a polybenzoxazole or polybenzothiazole filament, which comprises heating the filament to a temperature in the range of from about 25° C. to about 290° C., while applying a tension thereto of at least about 9 percent of the initial tensile strength of the filament, which is carried out at a line speed of at least 100 m/minute; and there is no prior or subsequent heating of the fiber to any temperature greater than 290° C.

13. The process of claim 12 which is carried out a as continuous process at a line speed of at least about 150 m/min.

14. The process of claim 12 wherein the tension is at least about 25 percent of the initial tensile strength of the filament.

15. The process of claim 12 wherein the tension is at least about 50 percent of the initial tensile strength of the filament.

16. The process of claim 12 wherein the filament has an initial moisture content of at least 15 percent and is dried to a residual moisture content of the filament is less than about 10 percent.

17. The process of claim 12 wherein the filament has an initial moisture content of at least 15 percent and is dried to a residual moisture content of the filament is less than about 5 percent.

18. The process of claim 12 wherein the tensile modulus of the filament obtained by the process is at least about 30 Msi.

19. The process of claim 12 wherein the tensile modulus of the filament obtained by the process is at least about 40 Msi.

* * * * *